US007070442B2

(12) United States Patent
Yamanashi et al.

(10) Patent No.: US 7,070,442 B2
(45) Date of Patent: Jul. 4, 2006

(54) STRUCTURE FOR PRESS-CONNECTING SHEATHED ELECTRIC WIRE WITH TERMINAL

(75) Inventors: Makoto Yamanashi, Shizuoka (JP); Takashi Muro, Shizuoka (JP); Kei Sato, Shizuoka (JP); Chitoshi Nakamura, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/000,402

(22) Filed: Dec. 1, 2004

(65) Prior Publication Data

US 2005/0118872 A1 Jun. 2, 2005

(30) Foreign Application Priority Data

Dec. 1, 2003 (JP) ..... P2003-401739

(51) Int. Cl.
*H01R 11/20* (2006.01)

(52) U.S. Cl. ..... 439/417; 439/404

(58) Field of Classification Search ..... 439/417, 439/404

See application file for complete search history.

(56) References Cited

U.S. PATENT DOCUMENTS 5,338,220 A * 8/1994 Soes et al. ..... 439/403
5,492,485 A * 2/1996 Drewanz et al. ..... 439/404
5,498,172 A * 3/1996 Noda ..... 439/404
5,540,600 A * 7/1996 Ivey ..... 439/417
5,820,404 A * 10/1998 Chishima et al. ..... 439/417
5,890,924 A * 4/1999 Endo et al. ..... 439/417
6,027,362 A * 2/2000 LaCroix ..... 439/404
6,273,745 B1 * 8/2001 Yeh ..... 439/404
6,315,596 B1 * 11/2001 Chen ..... 439/417
6,517,374 B1 * 2/2003 Maeda ..... 439/417
6,676,437 B1 * 1/2004 Imaizumi ..... 439/395

FOREIGN PATENT DOCUMENTS

JP 6-19293 U 3/1994
JP 9-22744 A 1/1997

* cited by examiner

*Primary Examiner*—Tulsidas C. Patel
*Assistant Examiner*—Vladimir Imas
(74) *Attorney, Agent, or Firm*—Sughrue Mion, PLLC

(57) ABSTRACT

A terminal support has a first main body. Wall plates are arrayed on the first main body in a first direction so as to define a first space between each of adjacent ones of the wall plates. The first space is adapted to receive a terminal having a blade portion and a sheathed electric wire. The blade portion extends in the first direction, and no clearance is formed between both ends in the first direction of the terminal and the adjacent ones of the wall plates. Chamfered portions are formed on both sides in the first direction of a tip end of each of the wall plates. A punch has a second main body. Press members are arrayed on the second main body in the first direction so as to define a second space between each of adjacent one of the press members. Each of the press members is inserted into the first space to press the sheathed electric wire against the blade portion of the terminal while each of the wall plates is inserted into the second space, when the terminal support and the punch are approached in a second direction orthogonal to the first direction.

10 Claims, 5 Drawing Sheets

STRUCTURE FOR PRESS-CONNECTING SHEATHED ELECTRIC WIRE WITH TERMINAL

BACKGROUND OF THE INVENTION

The present invention relates to a structure for electrically connecting sheathed electric wires with press-connection terminals for use in connectors.

FIG. 5 shows a crimping structure 50 disclosed in Japanese Utility Model Publication No. 6-19293U. In this structure, a blade 56 is formed with a crimper 53 for crimping one of insulative barrels 51 onto a sheathed electric wire 52, and a guide 55 extending along one of walls 54 opposing to each other while defining a space that the sheathed electric wire 52 and the insulative barrels 51 are placed. A blade 57 is formed with a crimper for crimping the other one of the insulative barrels 51 and a guide extending along the other one of the walls 54. Required number of the blade 56 and the blade 57 are alternately arranged in the axial direction of the sheathed electric wire 52. Grooves 58 are formed between each of adjacent blades 56 (57). The guide 55 is formed with a chamfered portion 59 for guiding associated one of the walls 54 into associated one of the grooves 58.

In order to deal with demands for the downsizing of connectors in recent years, terminals and used for those are made smaller and walls disposed between the terminals is also made thinner, because the terminals are arranged with a narrow space left therebetween (i.e., in a narrow pitch). In a case where the crimping structure 50 is applied to a connector with the narrow-pitched terminals thus arranged, the guide 55 is provided with the chamfered portion 59 for correcting the tilted wall 54 along the groove 58; however, the chamfered portion 59 becomes extremely small in dimension as the use of a narrow-pitched crimping tool is needed, whereby the wall 54 can hardly smoothly be guided along the groove 58. Consequently, the wall 54 may incorrectly collide with the chamfered portion 59, thereby the wall 54 is damaged and it is impossible to ensure the electrical connection therebetween. In a case where the clearance between the wall 54 and the groove 58 is too small, the same result is caused. In a case where the clearance is too large, the wall 54 will not be appropriately held within the groove 58.

Similar explanation is applicable to a structure that a press-connection terminal is placed between opposing walls and a sheathed electric wire is pressed against the press-connection terminal in order to establish electrical connection therebetween. Specifically, in a case where a blade of the press-connection terminal is tilted along the tilted wall, there is anxiety that desired electrical connection cannot be obtained.

SUMMARY OF THE INVENTION

It is an object of the invention to provide a structure for reliably establishing electrical connection between a press-connection terminal in a connector and a sheathed electric wire.

In order to achieve the above object, according to the invention, there is provided a structure for press-connecting a sheathed electric wire with a terminal having a blade portion, comprising:

a terminal support, comprising:

a first main body;

a plurality of wall plates, arrayed on the first main body in a first direction so as to define a first space between each of adjacent ones of the wall plates, the first space being adapted to receive the terminal and the sheathed electric wire; and chamfered portions, formed on both sides in the first direction of a tip end of each of the wall plates; and a punch, comprising:

a second main body; and a plurality of press members, arrayed on the second main body in the first direction so as to define a second space between each of adjacent one of the press members, the punch being configured such that each of the press members is inserted into the first space to press the sheathed electric wire against the blade portion of the terminal while each of the wall plates is inserted into the second space, when the terminal support and the punch are approached in a second direction orthogonal to the first direction, wherein the terminal is disposed such that the blade portion extends in the first direction, and no clearance is formed between both ends in the first direction of the terminal and the adjacent ones of the wall plates.

With the above configuration, since the chamfered portions are formed on the both sides in the first direction of the tip end of each of the wall plates, each of the press members is smoothly guided into the first space, so that smooth engagement between the terminal supporter and the punch can be attained. In addition, since no clearance is formed between the both ends in the first direction of the terminal and the adjacent ones of the wall plates, the terminal is securely fixed within the first space while the sheathed electric wire is pressed against the blade portion of the terminal. Therefore, reliable electric connection between the electric wire and the terminal can be attained.

Preferably, both side faces in the first direction of each of the press members are slanted faces narrowing the second space toward the second main body.

With this configuration, since the press-connecting operation is proceeded in a manner that each tip end of the wall plates are inserted into the first space of the punch through the entrances enlarged by the slanted faces, the press members will not collide with the tip ends of the wall plates. Thus, any damage will not be caused on the wall plates, and smooth engagement between the terminal supporter and the punch can be attained.

Further, since the chamfered portions of each wall plate are brought into contact with the slanted faces of the press members while being guided into the first space, and the wall plate is finally fitted into the narrowed portions between the slanted faces, the wall plates can be firmly held between the press members without any backlash.

Preferably, the terminal support is a connector housing in which the terminal and the sheathed electric wire are assembled into the first space.

In this case, it is ensured that the terminal and the sheathed electric wire are electrically connected since stable press-connecting operation is performed as described above even if the connector housing has a narrow-pitched terminal arrangement.

Here, it is preferable that each of the chamfered portions and each of the slant faces are brought into contact with each other while being angled.

It is also preferable that both sides in the first direction of a tip end of each of the press members are chamfered.

In these cases, the engagement between the terminal supporter and the punch can be proceeded more smoothly.

Preferably, a first guide member is provided on the first main body so as to define a third space between the first guide member and an outermost one of the wail plates. A second guide member is provided on the second main body so as to define a fourth space between the second guide member and an outermost one of the press members. The third space receives the outermost one of the press members while the fourth space receives the first guide member when the terminal support and the punch are approached in the second direction. The terminal and the sheathed electric wire are not disposed in the third space.

In this case, since almost no stress is generated in the engagement between the first guide member and the fourth space, the first guide member and the second guide member appropriately serve as a guide for the engagement movement between the terminal supporter and the punch.

Here, it is preferable that one of both sides in the first direction of a tip end of the first guide member facing the third space is chamfered.

In these cases, the engagement between the terminal supporter and the punch can be proceeded more smoothly.

Preferably, each of the press members is formed with a groove extending in the first direction and adapted to receive the blade portion of the terminal.

In this case, since the blade position will not be pressed by the press member (i.e., excessive stress will not apply to the terminal 30) when the press connecting operation is performed, the accidental bending or flexure of the terminal can be avoided.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE INVENTION

One embodiment of the invention will be described below in detail with reference to the accompanying drawings.

Figure 1:
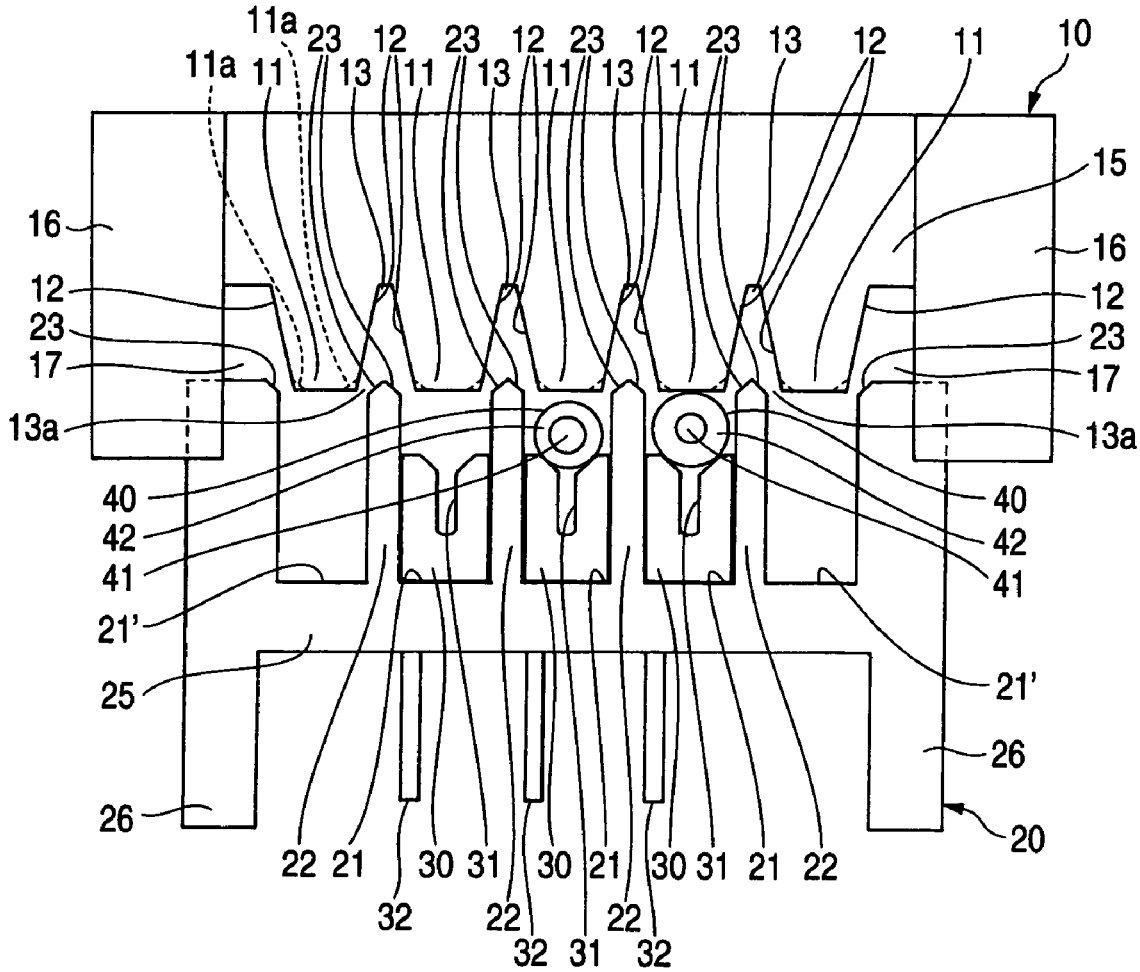
FIG. 1 is a front view of a press-connection structure according to one embodiment of the invention.
Figure 2:
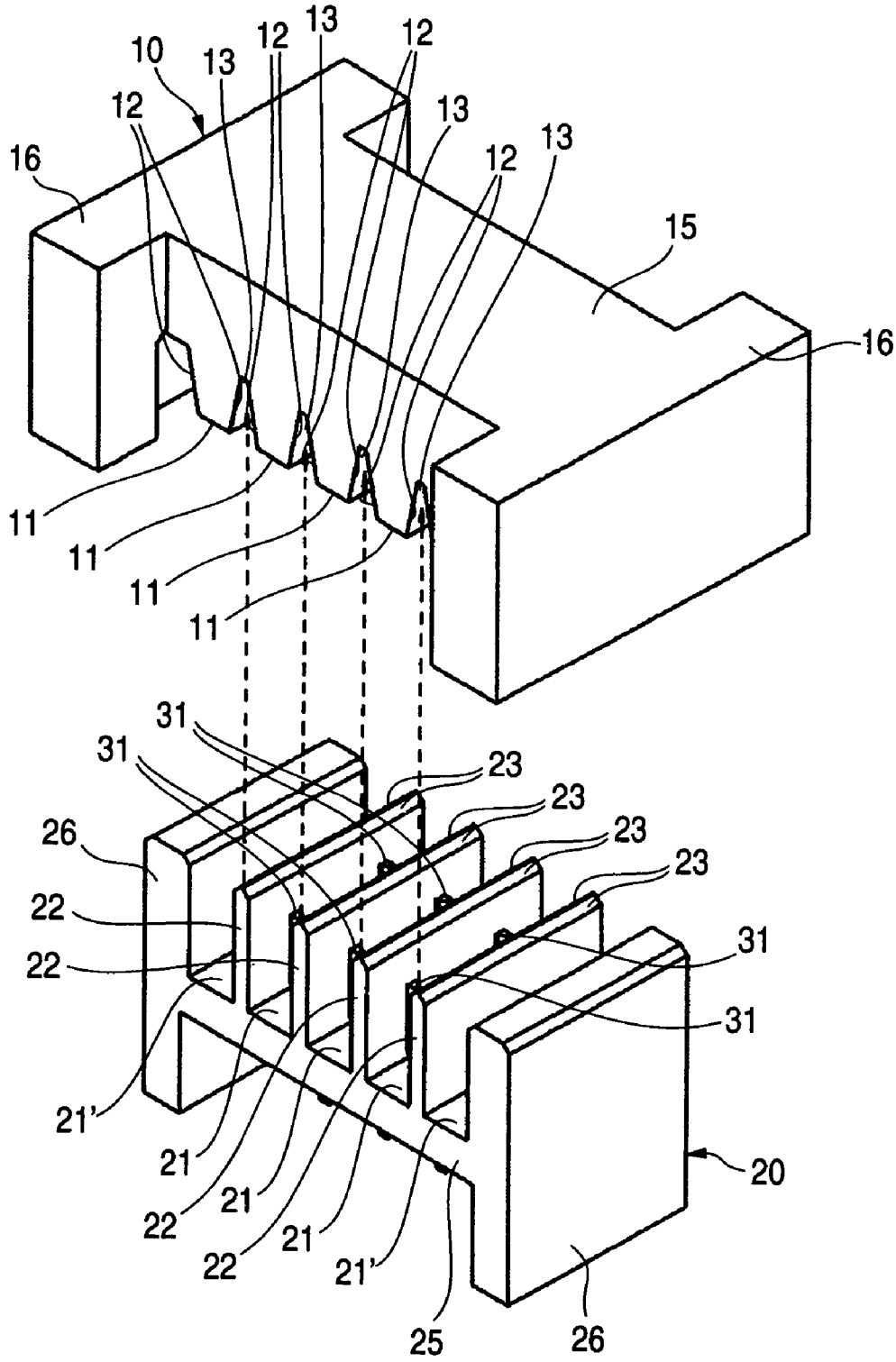
FIG. 2 is a perspective view of the press-connection structure, viewed from an upper side.
Figure 3:
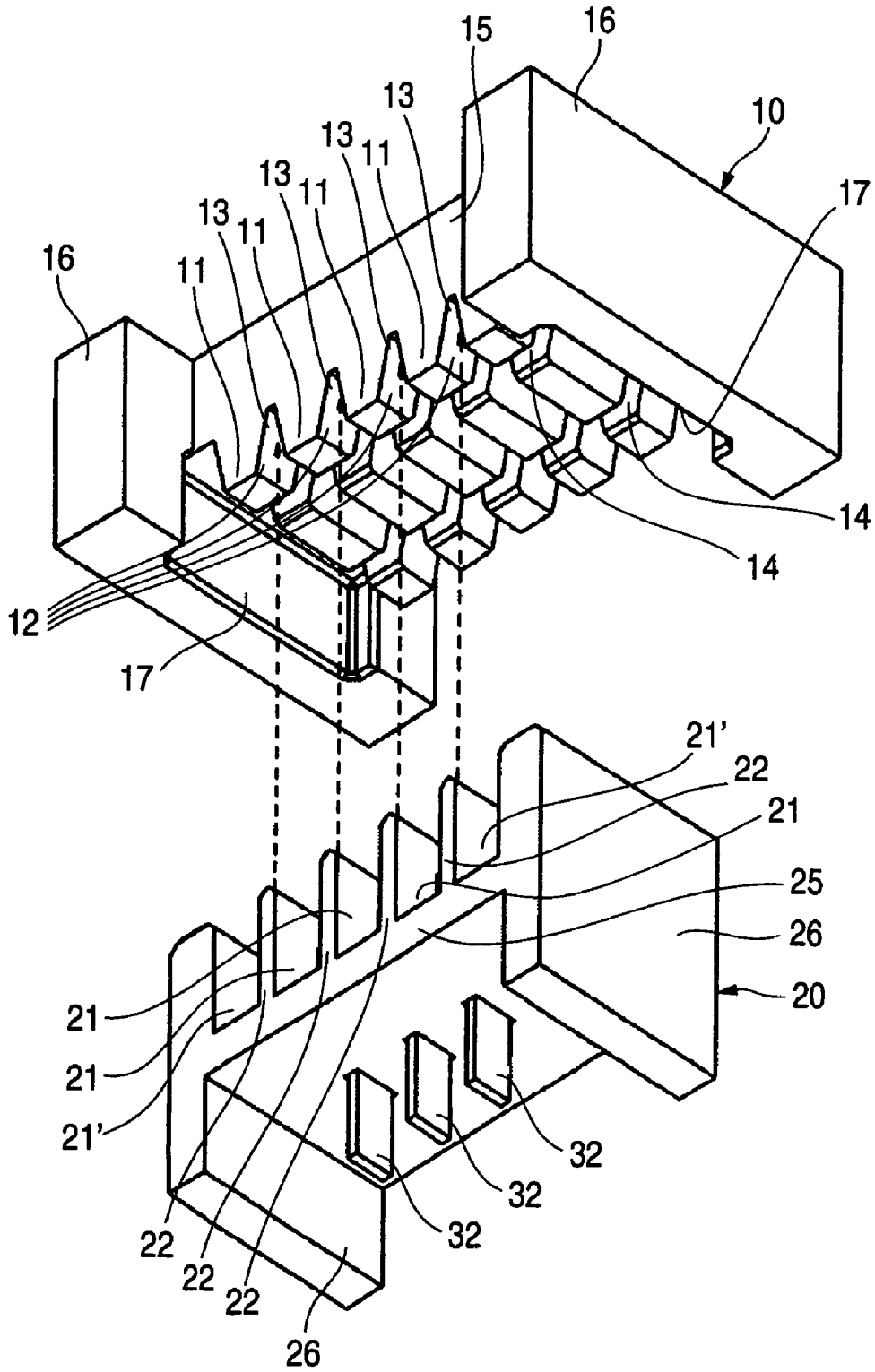
FIG. 3 is a perspective view of the press-connection structure, viewed from a lower side.

As shown in FIGS. 1 to 3, a connector housing 20 comprises a main body 25 on which a plurality of wall plates 22 extending parallel to each other are arrayed so as to define a terminal slot 21 capable of accommodating a press contact terminal 30 between each of the adjacent wall plates 22. A tip end of each wall plate 22 is formed with chamfered portions 23 so as to narrow the width of the wall plate 22. A sheathed electric wire 40 is placed on a blade 31 of the press-contact terminal 30 disposed in the terminal slot 21.

In this state, each of press members 11 formed in a punch 10 is pressed against the sheathed electric wire 40 from the upper side, so that an insulative sheath 42 of the sheathed electric wire 40 is cut by the blade 31 and electric connection is established between a core conductor 41 of the sheathed electric wire 40 and the blade 31 and the press-contact terminal 30. Both sides of each press member 11 is provided as slanted faces 12 so as to enlarge an entrance 13*a* of a groove 13 defined between each of adjacent press members 11 and facing the tip end of each wall plate 22.

Figure 4:
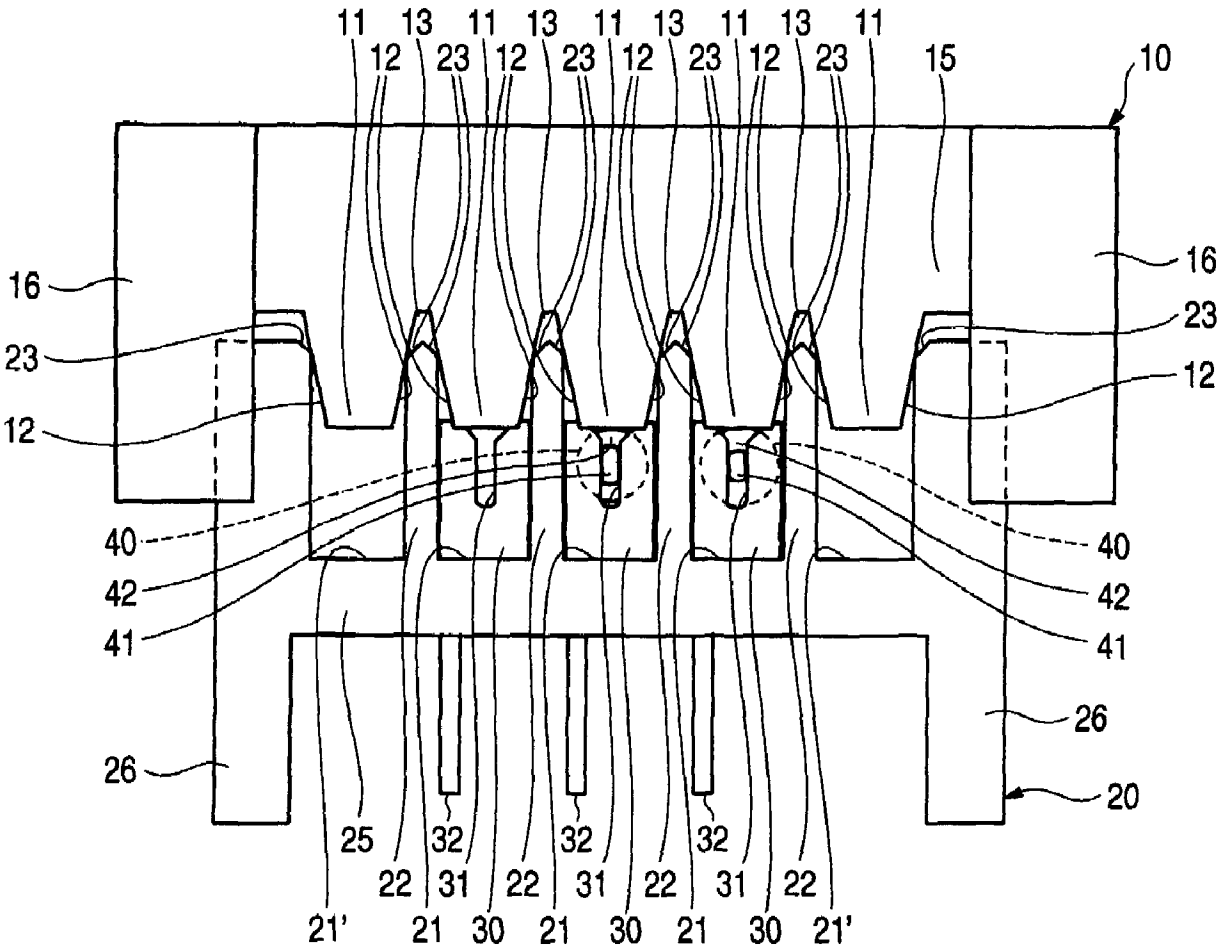
FIG. 4 is a front view of the press-connection structure, showing a state that a press-connecting operation is performed.
Figure 5:
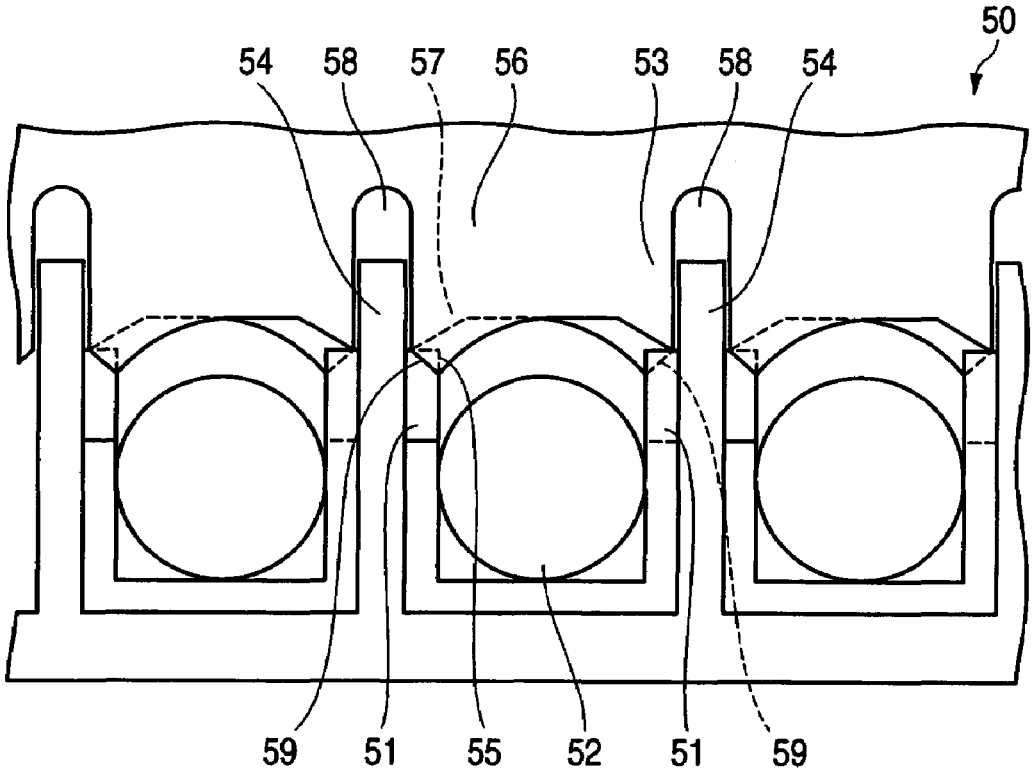
FIG. 5 is a front view of a related-art press-connection structure.

When the press-connecting operation is performed, the wall plates 22 of the connector housing 20 are respectively inserted from the entrances 13*a* into the grooves 13. The wall plates 22 are held within the grooves 13 in a state that the chamfered portions 23 respectively come in contact with the chamfered faces 12, as shown in FIG. 4

In the connector housing 20, guide members 26 are provided on both side end portions of the body 25. The wall plates 22 are arrayed between the guide members 26 so that a dummy slot 21' is defined between each outermost wall plate 22 and each guide member 26. An inner side of a tip end of each guide member 26 is formed with a chamfered portion 23 as well as the guide plates 22. Here, the press-contact terminals 30 may be disposed also in the dummy slot 21'.

On the other hand, guide receivers 16 are provided on both side end portions of the punch 10. The press members 11 are arrayed between the guide receivers 16 so that a groove 17 for receiving each guide member 26 is defined between each outermost press member 11 and each guide receiver 16. When the press-connecting operation is performed, the guide members 26 are held within the grooves 17 in a state that the chamfered portions 23 of the guide member 26 come in contact with the outer chambered faces 12 of the outermost press members 11.

Instead of the connector housing 20, a press-connection tool which pairs up with the punch 10 may be used. However, in this embodiment, the connector housing 20 serves as a terminal support in order to omit the work process for assembling the press-connection terminals 30 connected with the sheathed electric wires 40 into the connector housing 20. In a case where such a press-connection tool is adopted, the shape of the tool may have the same structure as the connector housing 20.

More specifically, in this embodiment, five press members 11 are arrayed between the guide receivers 16, thereby four grooves 13 are defined therebetween. As shown in FIG. 3, each of the press members 11 is formed with transversal grooves 14 for receiving the blades 31 of the press-connection terminal 30 when the press-connecting operation is performed. With this structure, since the blades 31 will not be pressed by the press members 11 (i.e., excessive stress will not apply to the press-connection terminal 30) when the press-connecting operation is performed, the accidental bending or flexure of the press-connection terminal 30 can be avoided.

On the other hand, four wall plates 22 are formed on the body 25 of the connector housing 20. Accordingly, three terminal slots 21 and two dummy slots 21' are defined by the wall plates 22 and the guide members 26.

The press-connection terminal 30 is formed by bending a metal sheet so as to have the blade 31 and an external contact 32. When the press-connection terminal 30 is disposed in the terminal slot 21, the external contact is extended from the lower face of the body 25.

The sheathed electric wire 40 is formed by covering the core conductor 41 composed of one or more conductive wires with the insulative sheath 42 made of insulative resin. The width and depth of the terminal slot 21 are determined in accordance with the outer shape of the press-connection terminal 30 and the outer diameter of the sheathed electric wire 40.

The details of the press-connecting operation will be explained. First, the press-connecting terminals 21 are respectively inserted into the terminal slots 21, and the sheathed electric wires 40 are respectively placed on the press-connection terminals 30. Next, the punch 10 is located at a position that the tip ends of the guide members 26 are respectively placed at the entrances of the grooves 17 of the guide receivers 16.

As shown in FIG. 4, the punch 10 is proceeded toward the connector housing 20 so that the guide members 26 are inserted into the grooves 17 while being guided. At the same time, the wall plates 22 are respectively inserted into the grooves 13 while the chamfered portions 23 are guided by the slanted faces 12.

As the press-connecting operation further proceeds, the sheathed electric wires 40 are pressed against the blades 31 of the press-connection terminals 30 by the press members 11, thereby the insulative sheaths 42 are cut by the blades 31. Upon the completion of the operation, the electrical connections between the core conductors 41 of the sheathed electric wires 40 and the press-contact terminals 30 are plenarily established. After that, the punch 10 is retracted from the connector housing 20 to complete the assembling operation.

With the above configuration, since the press-connecting operation is proceeded in a manner that the tip ends of the wall plates 22 of the connector housing 20 are inserted into the grooves 13 of the punch 10 through the entrances 13*a* enlarged by the slanted faces 12, the press members 11 will not collide with the tip ends of the wall plates 22. Thus, any damage will not be caused on the wall plates 22, and smooth engagement between the connector housing 20 and the punch 10 can be attained.

Further, since the chamfered portions 23 of the wall plates 22 are brought into contact with the slanted faces 12 of the press members 11 while being guided into the grooves 13, and the wall plates 22 are finally fitted into the narrowed portions between the slanted faces 12, the wall plates 22 can be firmly held between the press members 11 without any backlash.

As a result, it is ensured that the press-connection terminal 30 and the sheathed electric wire 40 are electrically connected since stable press-connecting operation is performed as described above even if the connector housing 20 has a narrow-pitched terminal arrangement.

In addition, since the tip ends of the guide members 26 of the connector housing 20 are inserted into the grooves 17 of the guide receivers 16 through the entrances enlarged by the slanted faces 12, the press members 11 will not collide with the tip ends of the guide members 26. Thus, any damage will not be caused on the guide members 26, and smooth engagement between the connector housing 20 and the punch 10 can be attained.

Further, since the chamfered portions 23 of the guide members 26 are brought into contact with the slanted faces 12 of the press members 11 while being guided into the grooves 17, and the guide members 26 are finally fitted into the narrowed portions between the slanted faces 12 and the guide receivers 16, the guide members 26 can be firmly held between the press members 11 and the guide receivers 16 without any backlash.

Incidentally, the press-connection structure according to the invention is not limited to the embodiment as described above but may properly be modified or improved.

For example, in the above embodiment, the chamfered portions 23 and the slanted faces 12 are planar. However, if the chamfered portions 23 and the slant faces 12 are brought into contact with each other diagonally, the planar faces may be provided as curved faces.

As shown by dashed lines in FIG. 1, the tip end portions 11*a* of the slanted faces 12 may be chamfered. In this case, the insertion of the wall plates 22 and the guide members 26 into the grooves 13 and 17 can be further facilitated.

The punch 10 may be proceeded toward the terminal support (the connector housing 20) manually or automatically with a proper actuator linked to the punch 10.

What is claimed is:

1. A terminal structure for press-connecting a sheathed electric wire with a terminal having a blade portion, the structure comprising:

a terminal support, comprising:

a first main body;

a plurality of wall plates, arrayed on the first main body in a first direction so as to define a first space between each of adjacent ones of the wall plates, the first space being adapted to receive the terminal and the sheathed electric wire; and chamfered portions, formed along both sides in the first direction of a tip end of each of the wall plates; and a punch, comprising:

a second main body; and a plurality of press members, arrayed on the second main body in the first direction so as to define a second space between each of adjacent ones of the press members, the punch being configured such that each of the press members is inserted into the first space to press the sheathed electric wire against the blade portion of the terminal while each of the wall plates is inserted into the second space, when the terminal support and the punch are approached in a second direction orthogonal to the first direction, wherein the terminal is disposed such that the blade portion extends in the first direction, and no clearance is formed between both ends in the first direction of the terminal and the adjacent ones of the wall plates.

2. The structure as set forth in claim 1, wherein both side faces in the first direction of each of the press members are slanted faces narrowing the second space toward the second main body.

3. The structure as set forth in claim 1, wherein the terminal support is a connector housing in which the terminal and the sheathed electric wire are assembled into the first space.

4. The structure as set forth in claim 1, further comprising:

a first guide member, provided on the first main body so as to define a third space between the first guide member and an outermost one of the wall plates; and a second guide member, provided on the second main body so as to define a fourth space between the second guide member and an outermost one of the press members, wherein:

the third space receives the outermost one of the press members while the fourth space receives the first guide member when the terminal support and the punch are approached in the second direction; and the terminal and the sheathed electric wire are not disposed in the third space.

5. The structure as set forth in claim 4, wherein one of both sides in the first direction of a tip end of the first guide member facing the third space is chamfered.

6. The structure as set forth in claim 2, wherein each of the chamfered portions and each of the slant faces are brought into contact with each other while being angled.

7. The structure as set forth in claim 2, wherein both sides in the first direction of a tip end of each of the press members are chamfered.

8. The structure as set forth in claim 1, wherein each of the press members is formed with a groove extending in the first direction and adapted to receive the blade portion of the terminal.

9. The terminal structure according to claim 1, further comprising:

a plurality of opening portions in the first main body at the bottom of each first space corresponding to each of the terminals; and an external contact portion protruding from each terminal and extending through one of said opening portions.

10. The structure as set forth in claim 9, further comprising:

a first guide member, provided on the first main body so as to define a third space between the first guide member and each outermost wall plate; and a second guide member, provided on the second main body so as to define a fourth space between the second guide member and each outermost press member, wherein the third space receives the outermost press member while the fourth space receives the first guide member when the terminal support and the punch are approached in the second direction.

* * * * *